US009937402B2

(12) United States Patent
Noel, III

(10) Patent No.: US 9,937,402 B2
(45) Date of Patent: Apr. 10, 2018

(54) SPEEDBAG PERFORMANCE MONITOR

(71) Applicant: Eras R. Noel, III, Palmdale, CA (US)

(72) Inventor: Eras R. Noel, III, Palmdale, CA (US)

(73) Assignee: Eras Roy Noel, III, Palmdale, CA (US)

( * ) Notice: Subject to any disclaimer, the term of this patent is extended or adjusted under 35 U.S.C. 154(b) by 192 days.

(21) Appl. No.: 14/984,267

(22) Filed: Dec. 30, 2015

(65) Prior Publication Data

US 2016/0220881 A1 Aug. 4, 2016

Related U.S. Application Data

(60) Provisional application No. 62/109,680, filed on Jan. 30, 2015.

(51) Int. Cl.

| | |
|---|---|
| ***A63B 69/22*** | (2006.01) |
| ***A63B 69/20*** | (2006.01) |
| ***A63B 24/00*** | (2006.01) |
| ***A63B 69/32*** | (2006.01) |
| ***A63B 71/06*** | (2006.01) |

(52) U.S. Cl.

CPC ..... *A63B 69/205* (2013.01); *A63B 24/0062* (2013.01); *A63B 69/32* (2013.01); *A63B 71/0619* (2013.01); *A63B 71/0669* (2013.01); *A63B 2024/0065* (2013.01); *A63B 2024/0068* (2013.01); *A63B 2220/30* (2013.01); *A63B 2220/80* (2013.01); *A63B 2220/833* (2013.01); *A63B 2225/20* (2013.01)

(58) Field of Classification Search

CPC ..... A63B 69/205; A63B 69/32; A63B 2024/0065; A63B 2024/0068; A63B 2220/30; A63B 2220/80; A63B 2220/833

See application file for complete search history.

(56) References Cited

U.S. PATENT DOCUMENTS

| | | | | |
|---|---|---|---|---|
| 1,042,816 A | | 10/1912 | Nevels | |
| 2,249,309 A | | 7/1941 | Benkö | |
| 2,548,089 A | * | 4/1951 | Wycosky | A63B 69/205 248/324 |
| 3,933,354 A | | 1/1976 | Goldfarb et al. | |
| 4,088,315 A | | 5/1978 | Schemmel | |
| D258,115 S | * | 2/1981 | Piatek | 248/317 |
| 4,440,400 A | | 4/1984 | Neuberger | |

(Continued)

*Primary Examiner* — Joshua T Kennedy

(74) *Attorney, Agent, or Firm* — Kilpatrick Townsend and Stockton LLP; John Lindemann

(57) ABSTRACT

An apparatus for measuring athletic performance includes a swivel joint that includes a housing, a coupling member and a sensing device. The housing includes first and second arms, each arm defining an aperture therethrough, the arms defining a gap and being oriented with the respective apertures aligned across the gap from one another. The coupling member includes an axle that passes through the apertures, is rotatable with respect to the housing, forms first and second attachment points, and forms a protrusion that extends outward from the axle. The coupling member further includes a bar that couples with the attachment points, and curves sufficiently to clear ends of the arms as the axle rotates within the apertures. The sensing device is responsive to produce an electrical signal representative of athletic performance when rotation of the coupling member moves the protrusion through a predefined rotational position within the gap.

20 Claims, 8 Drawing Sheets

(56) References Cited

U.S. PATENT DOCUMENTS 4,634,116 A 1/1987 Amador et al.
4,763,284 A 8/1988 Carlin
4,776,323 A 10/1988 Spector
4,818,234 A 4/1989 Redington et al.
4,850,224 A 7/1989 Timme
4,883,271 A 11/1989 French
4,940,228 A 7/1990 Horvath et al.
4,974,833 A 12/1990 Hartman et al.
5,052,683 A 10/1991 Wang et al.
5,100,138 A 3/1992 Wilde
5,221,243 A 6/1993 Walker
5,271,627 A 12/1993 Russell et al.
5,330,403 A 7/1994 Kuo
5,437,590 A 8/1995 D'Alto
5,484,364 A 1/1996 Boring
5,503,606 A 4/1996 Stephens
5,605,336 A * 2/1997 Gaoiran ..... A63B 24/00 273/445
5,624,358 A 4/1997 Hestilow
5,702,323 A 12/1997 Poulton
5,716,302 A 2/1998 Andersson
5,723,786 A 3/1998 Klapman
5,733,193 A * 3/1998 Allard ..... A63B 69/205 463/8
5,788,612 A 8/1998 Rennick
5,800,320 A 9/1998 Ray
5,803,877 A 9/1998 Franey
5,921,895 A 7/1999 Lynch et al.
5,921,896 A 7/1999 Boland
5,941,801 A 8/1999 D'Alto
5,944,639 A 8/1999 Ray
6,056,674 A 5/2000 Cook
6,220,992 B1 4/2001 Shafik
6,397,151 B1 5/2002 Yamagishi et al.
6,464,622 B1 10/2002 Clark
6,508,747 B1 1/2003 Cook
6,544,099 B2 4/2003 Shafik
6,611,782 B1 8/2003 Wooster et al.
6,623,408 B1 9/2003 Kyle
6,669,600 B2 12/2003 Warner
6,765,726 B2 7/2004 French et al.
6,876,496 B2 4/2005 French et al.
7,014,526 B1 3/2006 Chamberlin
7,038,855 B2 5/2006 French et al.
7,115,051 B2 10/2006 Hansberry
7,128,692 B2 10/2006 Black
7,384,380 B2 6/2008 Reinbold et al.
7,465,257 B1 12/2008 Morgan, Jr.
7,479,094 B1 1/2009 Alexander
7,479,095 B2 1/2009 Wang
7,488,276 B2 2/2009 Luigi
7,513,852 B2 4/2009 Wilkins et al.
7,601,099 B2 10/2009 Kang
7,625,319 B2 12/2009 Kang et al.
7,771,320 B2 8/2010 Riley et al.
7,791,808 B2 9/2010 French et al.
7,837,599 B2 11/2010 Kowalczewski et al.
7,857,729 B2 12/2010 Sullivan et al.
7,862,485 B2 1/2011 Luigi
7,874,964 B2 1/2011 Reynolds
7,887,467 B2 2/2011 Booker
7,909,749 B2 3/2011 Sheedy
7,967,728 B2 6/2011 Zavadsky et al.
7,993,249 B1 8/2011 Fassl et al.
8,079,938 B2 12/2011 Jones et al.
8,221,291 B1 7/2012 Kantarevic
8,371,995 B2 2/2013 Crawford
8,568,278 B2 10/2013 Riley et al.
8,777,819 B1 7/2014 Quintana
8,784,271 B2 7/2014 Brumback et al.
8,840,569 B2 9/2014 Flaction et al.
8,900,103 B1 * 12/2014 Tabino ..... A63B 69/205 482/83
8,920,287 B2 12/2014 Doshi et al.
8,986,171 B2 3/2015 Feng et al.
2002/0094917 A1 * 7/2002 Wang ..... A63B 43/007 482/86
2003/0139254 A1 7/2003 Chang
2003/0216228 A1 11/2003 Rast
2003/0224879 A1 12/2003 Hansberry
2004/0058787 A1 3/2004 Lin
2004/0214694 A1 10/2004 Borreca
2004/0224826 A1 11/2004 O'Shea
2005/0209066 A1 9/2005 Penney
2006/0252608 A1 11/2006 Kang et al.
2007/0123390 A1 5/2007 Mathis
2007/0213182 A1 9/2007 Anderson
2007/0219059 A1 9/2007 Schwartz et al.
2008/0076636 A1 3/2008 Smith
2008/0125288 A1 5/2008 Case
2008/0179214 A1 7/2008 Hall
2008/0258921 A1 10/2008 Woo et al.
2009/0235761 A1 9/2009 Song
2010/0144414 A1 6/2010 Edis et al.
2010/0317489 A1 12/2010 Flaction
2011/0172060 A1 7/2011 Morales et al.
2012/0053016 A1 3/2012 Williamson
2012/0220430 A1 8/2012 Bucar et al.
2012/0238407 A1 9/2012 Dilworth et al.
2013/0005534 A1 1/2013 Rosenbaum
2013/0065731 A1 3/2013 Jones et al.
2013/0073064 A1 3/2013 Houvener et al.
2013/0231222 A1 9/2013 Hall
2013/0231223 A1 9/2013 Scully et al.
2014/0066267 A1 3/2014 Solah
2014/0128227 A1 5/2014 Ladas
2014/0155228 A1 6/2014 Salerno
2014/0228174 A1 8/2014 Olsen
2014/0243165 A1 8/2014 Hall
2014/0364278 A1 12/2014 Le et al.
2014/0378281 A1 12/2014 Mazi
2015/0018174 A1 1/2015 Partlo
2015/0065312 A1 3/2015 Harrigan
2015/0094191 A1 4/2015 Fradin

* cited by examiner

FIG. 4A
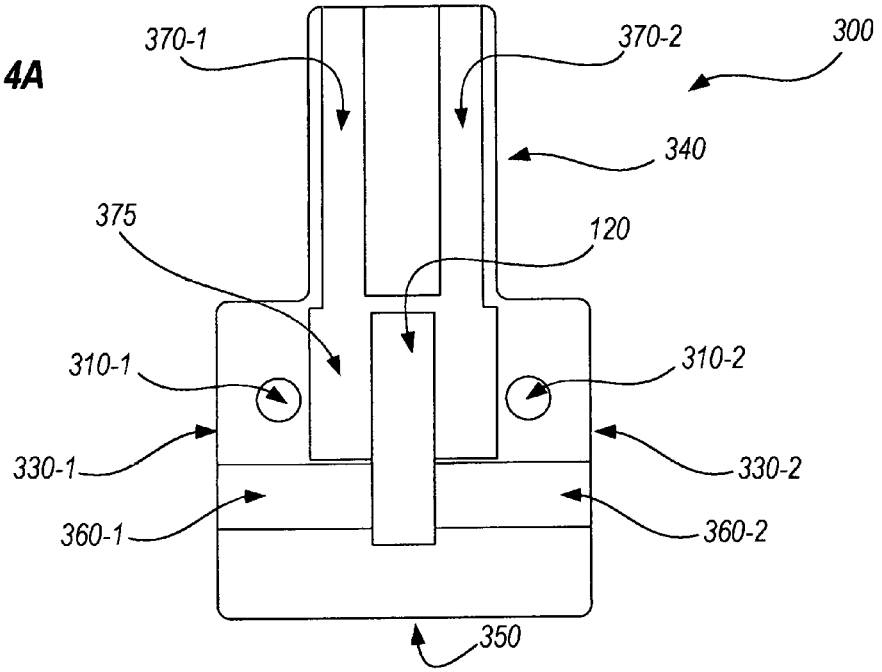
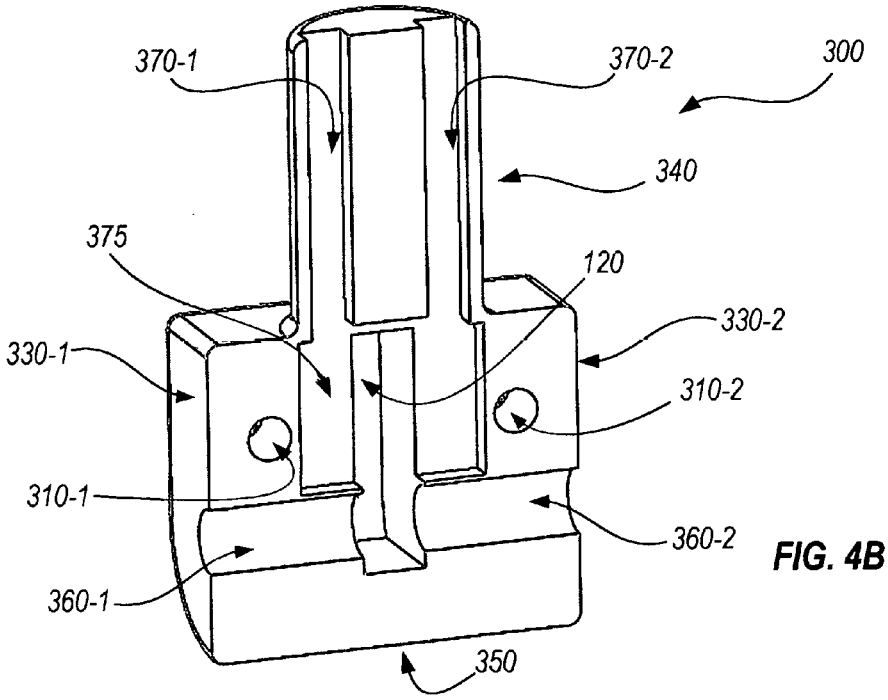
FIG. 4B

SPEEDBAG PERFORMANCE MONITOR

CROSS-REFERENCE TO RELATED APPLICATIONS

This application claims the benefit of priority to U.S. Provisional Patent Application No. 62/109,680, entitled "Real-Time Speed Bag Swivel and Real Time Interactive Display," filed 30 Jan. 2015 and incorporated herein by reference in its entirety.

BACKGROUND

Most athletes understand their performance in terms of metrics such as wins and losses, time, distance, weight and the like, while some athletes prefer additional detail. Although a goal may be to improve an athlete improve a specific metric, in some cases there can be intermediate information that could inform them of progress towards their goal. There are also certain sports in which these metrics are not direct reflections of improvement.

Boxing is a sport in which it is helpful to have metrics other than wins and losses to understand a participant's progress. Typically, a boxer's only means of knowing he is getting better is how he feels when he spars, if his coach tells him, or learning the results of his next official fight.

A speedbag apparatus, for example as shown in U.S. Pat. No. 8,371,995 B2 may be used as a device to improve a boxer's hand speed and timing. The device consists of a speedbag that bounces back and forth on a platform when struck. This device is typically used for hand speed timing training.

SUMMARY

In an embodiment, an apparatus for measuring athletic performance includes a swivel joint that includes a housing, a coupling member and a sensing device. The housing includes first and second arms, each arm defining an aperture therethrough, the arms defining a gap and being oriented with the respective apertures aligned across the gap from one another. The coupling member includes an axle that passes through the apertures, is rotatable with respect to the housing, forms first and second attachment points, and forms a protrusion that extends outward from the axle. The coupling member also includes a bar that couples with the attachment points, and curves sufficiently to clear ends of the arms as the axle rotates within the apertures. The sensing device is responsive to produce an electrical signal representative of athletic performance when rotation of the coupling member moves the protrusion through a predefined rotational position within the gap.

In an embodiment, another apparatus for measuring athletic performance includes a swivel joint that includes a housing, a coupling member and a sensing device. The housing includes a swivel post coupled with a lower portion, the lower portion defining at least one aperture therethrough. The coupling member includes an axle that passes through the aperture and is rotatable with respect to the housing, the axle forming a protrusion that extends radially outward from the axle in a first radial direction. The coupling member also includes a bar that couples with the axle, a dimension of the bar being sufficient for the bar to clear the lower portion of the housing as the axle rotates within the aperture, the bar extending radially in a second radial direction. The sensing device is mechanically coupled with the housing, and is responsive to produce an electrical signal representative of the athletic performance when rotation of the coupling member moves the protrusion through a predefined rotational position adjacent to the sensing device.

BRIEF DESCRIPTION OF THE DRAWINGS

The present disclosure is described in conjunction with the appended figures:

FIGS. 4A and 4B illustrate a mechanical unit that can join with another mechanical unit to form the housing of FIGS. 2A, 2B and 2C, in accord with an embodiment.

DETAILED DESCRIPTION

A device that can sense how often a speedbag is struck, and easily integrates into present day speedbag designs, is disclosed herein. Advantages provided by certain embodiments include determining speed at which a speedbag is hit without significantly changing the physical construction and response of the speedbag, providing the user with a real time display showing how fast they are punching the speedbag, and providing the user with information such as average speed, total punches, consistency of speed, etc. that can be stored and analyzed for later use in analyzing the improvement of hand speed and timing.

Figure 1:
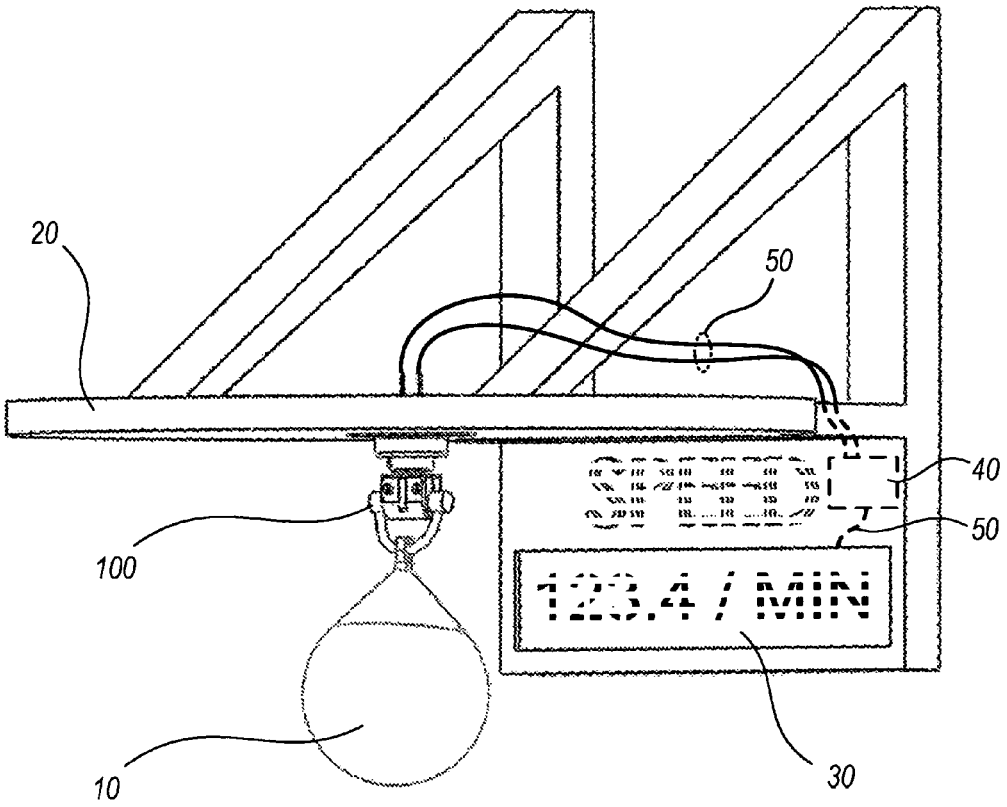
FIG. 1 illustrates a speedbag mounted to a platform with a speedbag performance monitor, in accord with an embodiment.

FIG. 1 illustrates a speedbag 10 mounted to a platform 20 with a speedbag performance monitor 100. Speedbag performance monitor 100 is a swivel joint that couples speedbag 10 with platform 20 and allows speedbag 10 to move about like a typical speedbag, while producing electrical signals corresponding to motion of speedbag 10, and transmitting the signals via one or more connections 50 to a processor 40. Connections 50 are shown for illustrative purposes as two physical wires, but the two wires shown represent any number of physical and/or wireless connections, as discussed further herein. Processor 40 processes the electrical signals by counting portions of the electrical signals that correspond with motion of speedbag 10, to determine a measure of athletic performance of a user punching speedbag 10. The measure of athletic performance can be transmitted to a display 30, as shown, and/or can be transmitted or stored to other devices or networks for later use or analysis. Construction and operational details of speedbag performance monitor 100 are provided below.

Figure 2A:
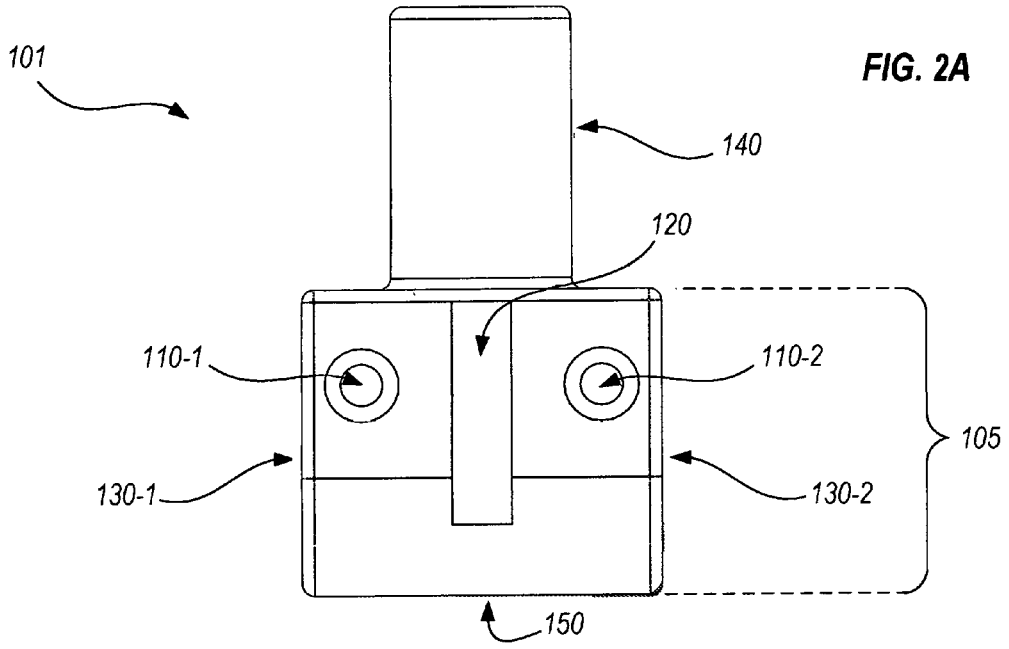
FIGS. 2A, 2B and 2C illustrate a housing of the speedbag performance monitor of FIG. 1.
Figure 2B:
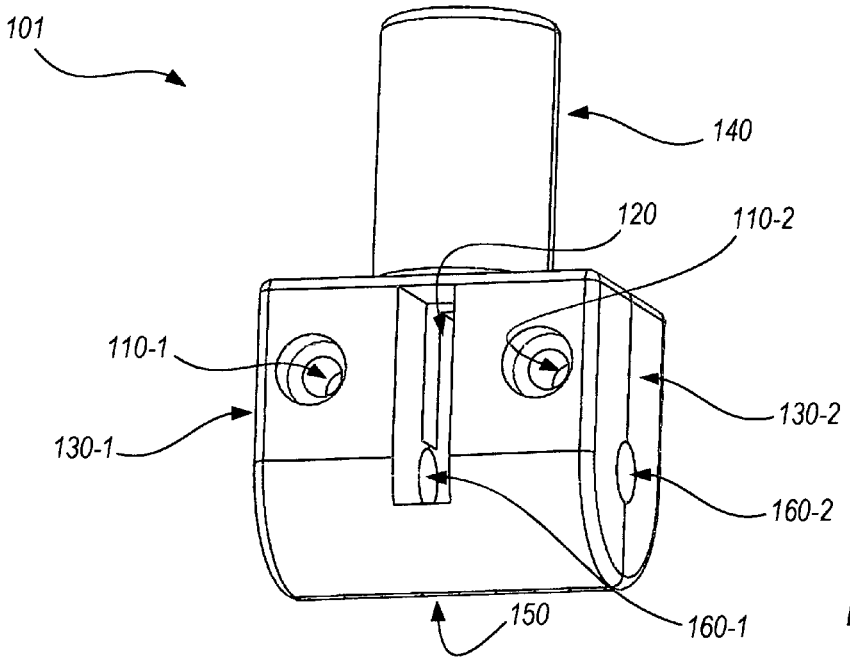
Figure 2C:
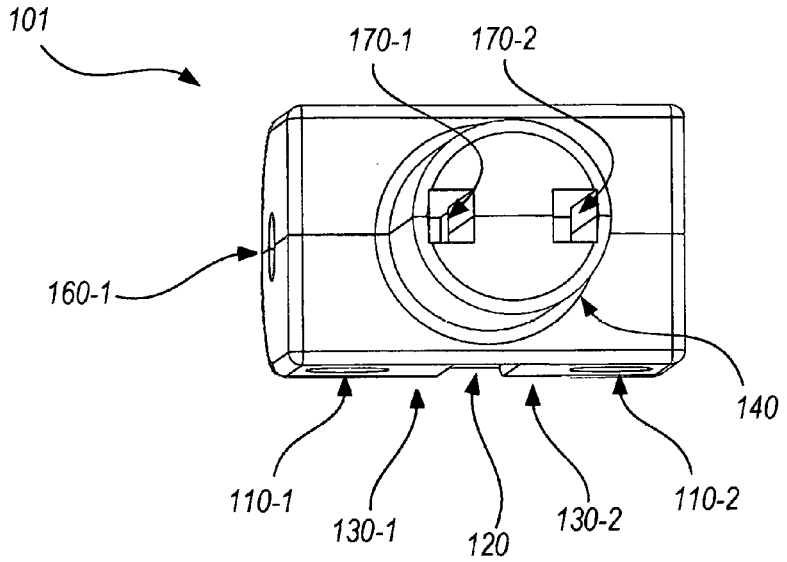

FIGS. 2A, 2B and 2C illustrate a housing 101 of speedbag performance monitor 100. FIG. 2A is a front elevation of housing 101. FIG. 2B is a view that shows housing 101 tilted slightly, to show features obscured in the view of FIG. 2A. FIG. 2C is a view that looks down onto housing 101, as compared to the perspectives of FIGS. 2A and 2B. Housing 101 includes a swivel post 140 that is coupled with first and second arms 130-1, 130-2 that define a gap 120 therebetween. Each of first and second arms 130-1, 130-2 defines a screw aperture 110-1, 110-2, and as shown in FIG. 2B, each of first and second arms 130-1, 130-2 also defines a respective aperture 160-1, 160-2, and apertures 160-1, 160-2 align with one another across gap 120. In the illustrated embodiment of housing 101, arms 130-1, 130-2 separate at a proximal end below swivel post 140, couple at their distal ends with a cross member 150 (although this is not required, e.g., arms 130-1, 130-2 may simply end without coupling at their distal ends). FIG. 1A indicates that first and second arms 130-1, 130-2 and cross member 150, when present, may be collectively defined as a lower portion 105 of housing 101. Apertures 110-1, 110-2 may not intersect one another, as suggested by FIGS. 2A and 2B, but this is also not required. FIG. 2C illustrates apertures 170-1 and 170-2 formed within swivel post 140. Housing 101 is typically made of metal and may be manufactured by conventional methods including machining, milling, casting, sand casting, three dimensional printing and the like.

Figure 3:
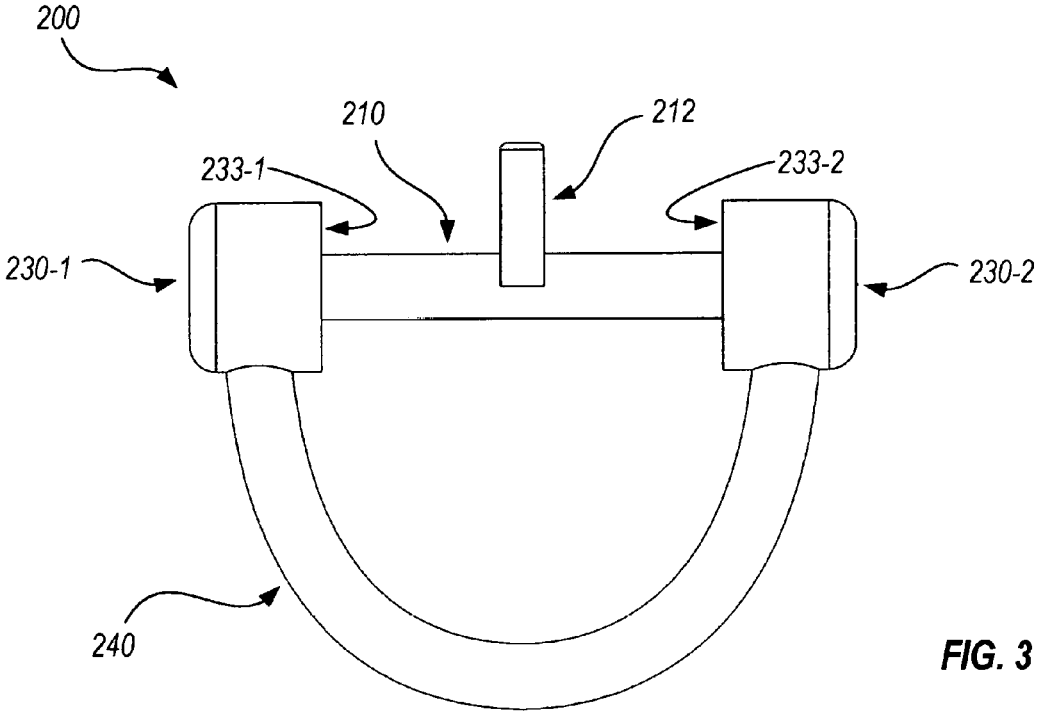
FIG. 3 is a front elevation of a coupling member that cooperates with the housing of FIGS. 2A, 2B and 2C to attach a speedbag and to measure athletic performance of a user of the speedbag, in accord with an embodiment.
Figure 5:
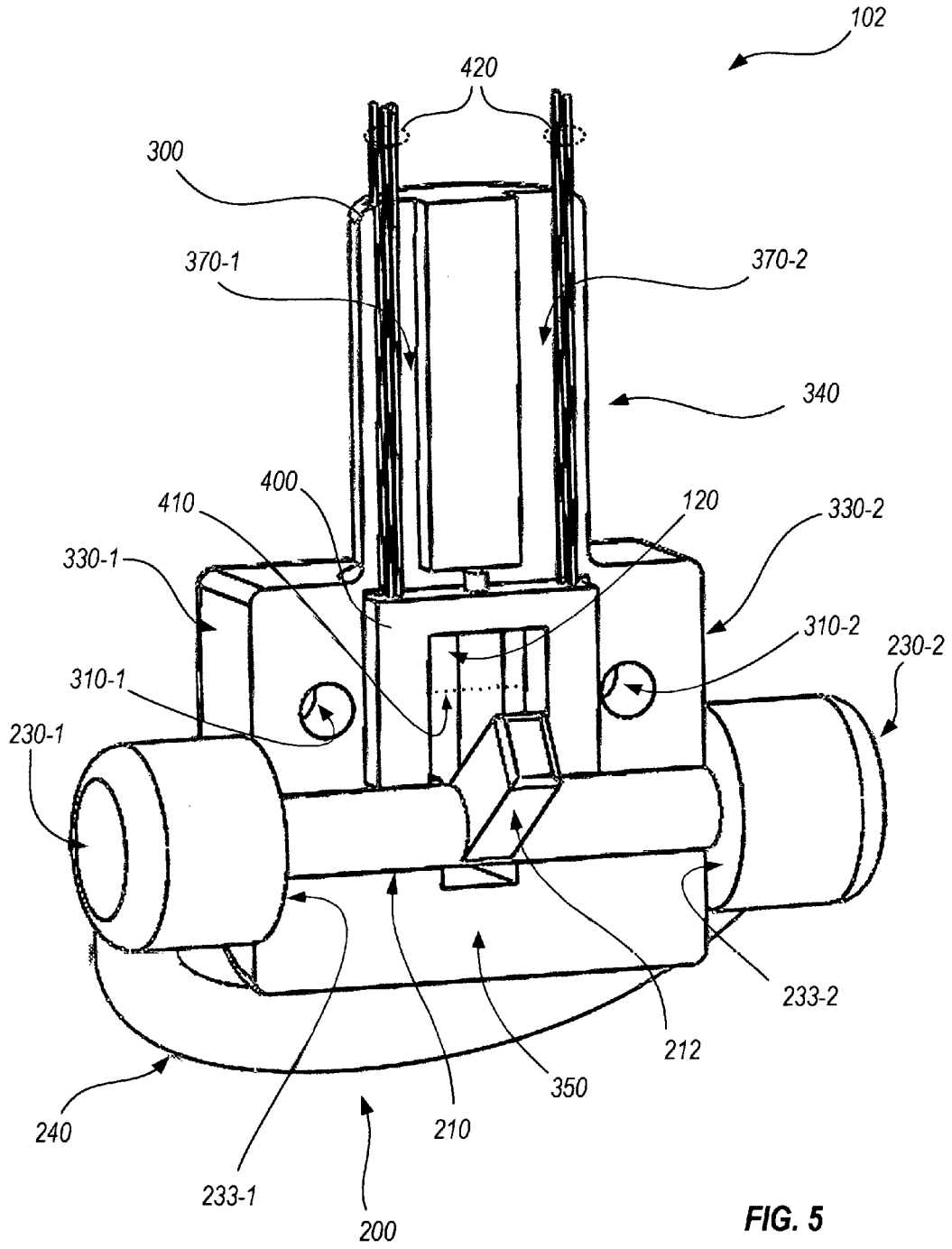
FIG. 5 illustrates a partial assembly of the speedbag performance monitor of FIG. 1, in accord with an embodiment.
Figure 6:
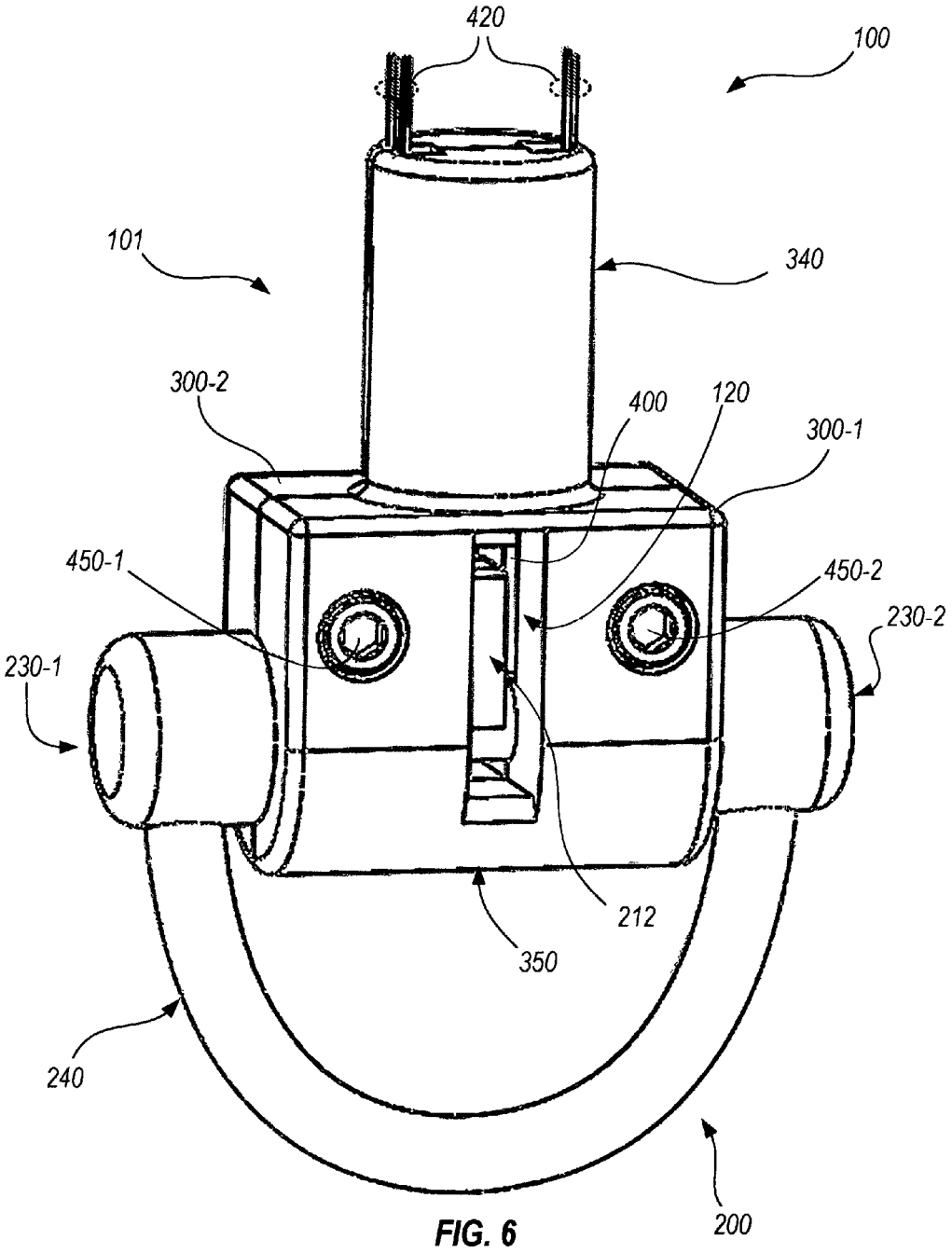
FIG. 6 shows the speedbag performance monitor of FIG. 1 fully assembled, in accord with an embodiment.
Figure 8:
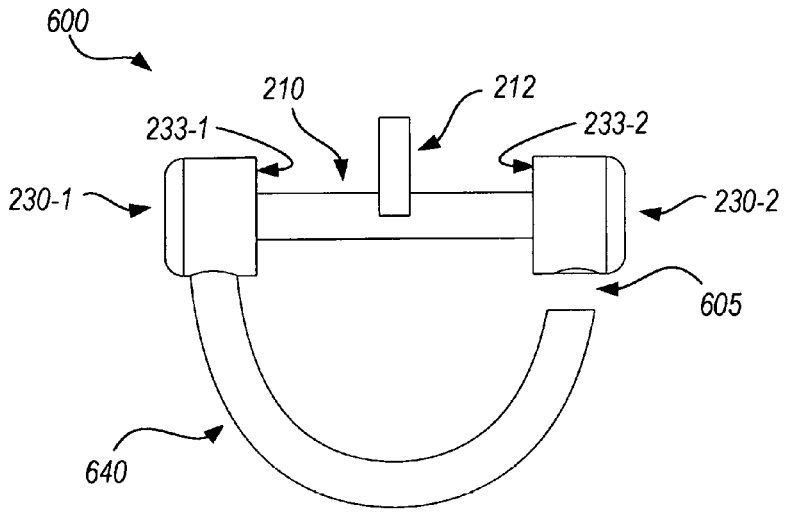
FIG. 8 is a front elevation illustrating an alternative coupling member that can couple a speedbag with a housing to measure athletic performance of a user of the speedbag, in accord with an embodiment.

FIG. 3 is a front elevation of a coupling member 200 that cooperates with housing 101 to couple speedbag 10 (FIG. 1) and to measure athletic performance of a user of speedbag 10. Coupling member 200 couples speedbag 10 with housing 101 while also providing appropriate mechanical freedom for speedbag 10, thus facilitating sensing of a user's athletic performance, as described further below. Coupling member 200 includes an axle 210 with a protrusion 212 that extends radially outward from axle 210. Axle 210 is sized to be disposed within apertures 160-1, 160-2 of housing 101, FIGS. 2A-2C, with protrusion 212 extending into gap 120, as shown in FIGS. 5 and 6. In the embodiment shown in FIG. 3, axle 210 forms attachment points 230-1, 230-2. The enlarged aspect of attachment points 230-1 and 230-2 relative to a diameter of axle 210 that FIG. 3 illustrates is not strictly required, but helps to constrain side-to-side motion of coupling member 200 and speedbag 10 relative to housing 101 when fully assembled. That is, shoulder portions 233-1 and 233-2 noted in FIG. 3 may be spaced along axle 210 so as to fit closely about sides of housing 101. A bar 240 (sometimes referred to as a "U-bar") couples with each of attachment points 230-1, 230-2. A curvature or other dimension of bar 240 is sufficient for bar 240 to clear ends of arms 130-1, 130-2 as axle 210 rotates within apertures 160-1, 160-2 of housing 101; see, e.g., FIGS. 5 and 6. Coupling member 200 is also typically made of metal and may be manufactured by conventional methods including machining, milling, casting, sand casting, three dimensional printing and the like. In other embodiments, attachment points 230-1, 230-2 may not be present, that is, coupling member 200 may simply form a smooth curve from an axle portion to a U-bar portion. Also, bar 240 may attach to axle 210 at one side only, such as shown in FIG. 8.

FIGS. 4A and 4B illustrate a mechanical unit 300 that can join with another mechanical unit 300 to form housing 101 shown in FIGS. 2A, 2B and 2C. FIG. 4A is a front elevation of mechanical unit 300, and FIG. 4B is a view that shows mechanical unit 300 tilted slightly, to show features obscured in the view of FIG. 4A. Mechanical unit 300 includes a swivel post portion 340 that defines recesses 370 therein, and arm portions 330-1 and 330-2 on respective sides of gap 120 that define respective aperture portions 310-1, 310-2 therein.

Aperture portions 310-1, 310-2 may be simple cylindrical apertures as shown, or may be internally threaded to couple with screws, bolts or other fasteners, and/or may form further recesses or cooperating shapes at external ends thereof (e.g., a recess sized and/or shaped to constrain a nut or other device to retain a bolt). Recesses 370-1, 370-2 adjoin a larger recess 375, a portion of which is defined in each arm portion 330-1, 330-2. In the illustrated embodiment, arm portions 330-1, 330-2 couple at their distal ends with a cross member portion 350 (although this is not required, e.g., arm portions 330-1, 330-2 may simply end without coupling at their distal ends). Arm portions 330-1 and 330-2 also form recesses 360-1, 360-2, as shown. Recesses 360-1, 360-2 of mechanical unit 300 are sized and arranged such that when two mechanical units 300 are brought together, recesses 360-1, 360-2 align to form apertures 160-1, 160-2 shown in FIGS. 2B, 2C such that axle 210 of coupling member 200, FIG. 3, can be disposed therein. This facilitates assembly of speedbag performance monitor 100 by allowing two mechanically distinct units 300 to be joined face to face to form housing 101, with axle 210 of coupling member 200 disposed within aperture 160 that is formed by recesses 360-1, 360-2 of the two units, and with a sensing device disposed within recess 375, as illustrated in FIGS. 5 and 6.

FIG. 5 illustrates a partial assembly 102 of speedbag performance monitor 100, to show how certain parts thereof work in the final assembly, where they are hidden from view. Mechanical unit 300 is shown with coupling member 200 in place, with axle 210 seated within (and blocking view of) recesses 360-1, 360-2 (see FIGS. 4A, 4B). A sensing device 400 is also shown in place, seated partially within (and blocking view of) recess 375 (see FIGS. 4A, 4B).

Sensing device 400 may be, for example, a photointerruptor available from SHARP Corporation as model GP1A57HRJ00F Transmissive Photointerruptor. One side of sensing device 400 is a light source that generates a light beam 410 passing across gap 120, as shown. As a speedbag moves coupling member 200, coupling member 200 swivels within apertures 160-1, 160-2 such that protrusion 212 moves and breaks light beam 410 when protrusion 212 is within gap 120. Another side of sensing device 400 includes a photosensor that senses the presence or absence of beam 410. Wires 420 that provide power, ground return and sensor-generated electrical signal connectivity with sensing device 400 are disposed within recesses 370-1, 370-2 as shown.

FIG. 6 shows speedbag performance monitor 100 fully assembled, with fasteners in the form of bolts 450-1, 450-2 coupling mechanically distinct units 300-1, 300-2 to form housing 101, and with coupling member 200 and sensing device 400 in place, as shown in FIG. 5. It will be appreciated by one of skill in the art that when swivel post 340 is rotatably coupled within a platform (e.g., platform 20, FIG. 1) and a speedbag is coupled with bar 240, that performance monitor 100 will act as a swivel joint to provide the speedbag with the same mechanical freedom of movement as a typical speedbag. Coupling member 200 is shown in a vertical position such that protrusion 212 is within gap 120, breaking light beam 410 (not shown; see FIG. 5). Typical dimensions of portions of monitor 100 include swivel post 340 having a diameter of about ¾ inch to 1 inch, and bar 240 having a diameter of about ¼ inch, although these dimensions can vary depending on the strength of materials used and intended ruggedness of a particular implementation. Housing 101 can also vary in size according to size of a particular sensing device 400 selected for use.

With reference now to FIG. 1, in use, housing 101 of speedbag performance monitor 100 couples with platform 20 and speedbag 10 couples with coupling member 200 such that, at a minimum, coupling member 200 is free to rotate within apertures 160-1, 160-2. In certain embodiments, swivel post portion 340 is held rigidly to platform 20, for example using a set screw or other clamping type apparatus. In other embodiments, swivel post portion 340 attaches to a slip ring mount such that housing 101 can rotate azimuthally around swivel post portion 340 and speedbag 10 can move with a corresponding rotational freedom. The slip ring mount has a fixed and a rotatable portion. The rotatable portion connects with wires 420 of speedbag performance monitor 100, and provides internal connection paths that allow wires 420 and swivel post portion 340 to rotate, while providing and maintaining electrical continuity to electrical contacts in the fixed portion during such rotation. The electrical contacts in the fixed portion can then be connected (e.g., as connections 50) without concern that they will be twisted and broken by the rotation.

When speedbag 10 rotates protrusion 212 through a predefined rotational position, protrusion 212 will pass through gap 120, breaking light beam 410. In response to the interruption of beam 410, sensing device 400 generates an electrical signal within one of connections 50. The electrical signal may be passed to a processor 40 to determine hits to speedbag 10. In certain embodiments, wires 420 from sensing device 400 (FIGS. 5, 6) extend to processor 40, FIG. 1, in which case wires 420 themselves are examples of connections 50; while in other embodiments, wires 420 connect with a local power supply (e.g., a battery) and a wireless transmitter to form a wireless connection 50 with processor 40. Thus, both wires and wireless connections are regarded as means for transmitting the electrical signal to a processor remote from the swivel joint. Wireless connections may be made for example using Bluetooth or Bluetooth Low Energy protocols; 3G/4G cellular phone carrier, IEEE 802.11 based ("WiFi") communication; IEEE 802.15.4 based protocols such as Zigbee, and the like. Processor 40 and/or an associated display 30 may be integrated with platform 20 as shown, or may be remotely located, such as in a mobile phone or tablet device. Processor 40 may also be, for example, an intermediate data gathering, short term storage, and networking device that processes the electrical signals from speedbag performance monitor 100 to provide raw performance information, then transmits the data through a network connection or wirelessly to a remotely located system for analysis and display.

Figure 7:
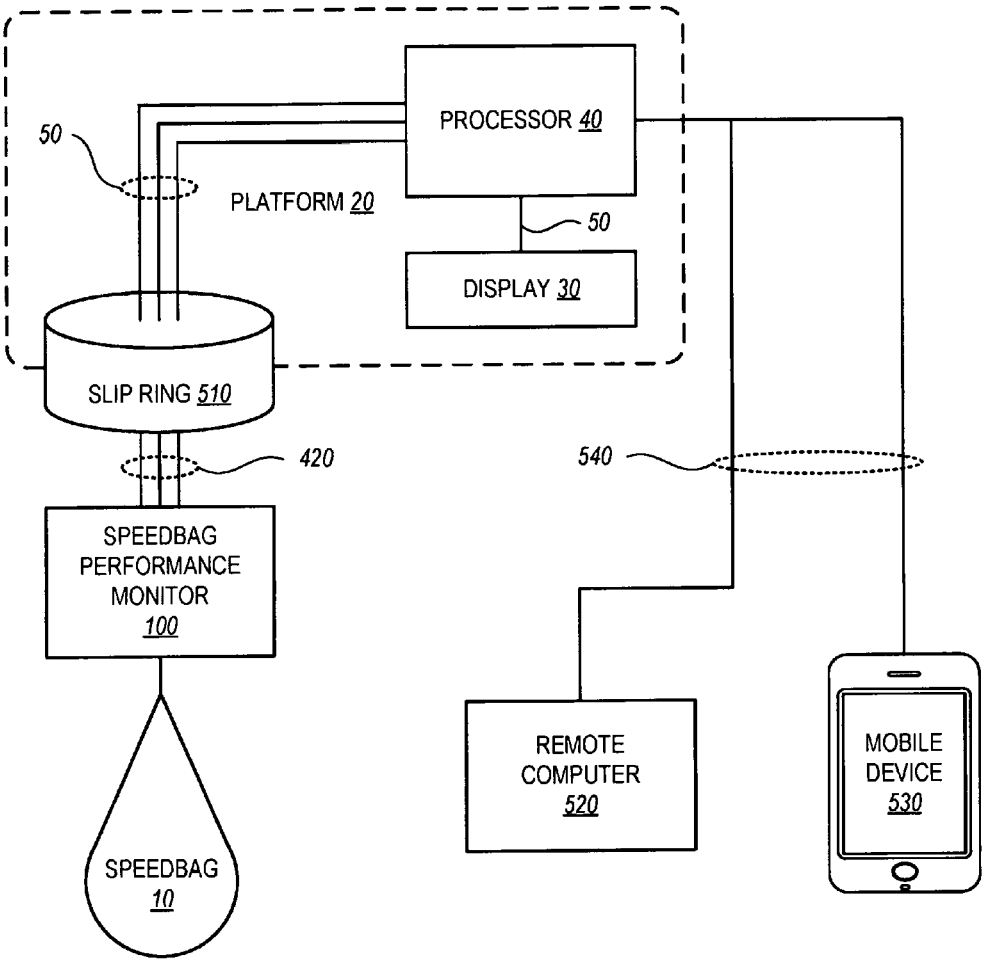
FIG. 7 schematically illustrates possible components of a speedbag performance monitoring system that utilizes the speedbag performance monitor of FIG. 1, in accord with embodiments.

FIG. 7 schematically illustrates possible components of a speedbag performance monitoring system 500 that utilizes speedbag performance monitor 100. In general, at least one speedbag 10 will be coupled with a platform 20 through at least a speedbag performance monitor 100. Monitor 100 may couple with platform 20 through a slip ring 510, but this is optional. Wires 420 from monitor 100 may extend directly as connections 50 to a processor 40 which may or may not be physically coupled with or disposed on platform 20. Processor 40 interprets electrical signals from monitor 100 into performance data, for example by counting a number of times that protrusion 212 moves through gap 120 in a given time period, dividing by two (because a user's punch causes speedbag 10 first to move away from the user and then rebound toward the user) and providing the result as a frequency or number of punches per minute. Processor 40 may in turn provide the performance data to a display 30 that may or may not be also physically coupled with or disposed on platform 20. Processor 40 may also provide the performance data through network connections 540 that may be wired or wireless connections, as discussed above, to one or more remotely located computer system(s) and/or display device(s) such as remote computer 520 and mobile device 530.

It is contemplated that specific embodiments may have only some, all, or multiples of some of the components shown in FIG. 7. For example, one embodiment might have two (or more) speedbags 10, each coupled with a single platform 20 through a respective speedbag performance monitor 100. In this embodiment, both speedbag performance monitors 100 may transmit electrical signals through wires 420 and connections 50 to a single processor 40, which displays results for each speedbag 10 in a single display 30, so that two (or more) users can have a "head to head" competition and immediately see their results. In another embodiment, platform 20 does not include a display 30, but sends performance information from processor 40 to one or more remote computers 520 and/or mobile devices 530 through wired or wireless network connections 540. In this embodiment, remote computer 520 and/or mobile device 530 interpret and display the received performance information using respective onboard processors, memory, display apparatus and the like.

It will be apparent to one skilled in the art that many variations of mechanically distinct units 300, coupling member 200, sensing device 400 and housing 101 are possible.

Exemplary mechanical variations include: forming larger or smaller portions of recesses 360-1, 360-2, 370-1, 370-2 and/or 375 within one mechanically distinct unit 300 as compared with the other, or forming a single recess corresponding to aperture 160 in only one of the mechanically distinct units 300; forming part or all of recesses 360-1, 360-2 within cross member portion 350; forming recesses 360-1, 360-2, 375 and/or aperture portions 310-1, 310-2 such that they adjoin one another; forming additional apertures in cross member portions 350 and/or swivel post portions 340 to receive additional fasteners for improved mechanical coupling between the mechanically distinct units 300, forming arm portions 330-1, 330-2 with differing shapes than those shown; forming one mechanically distinct unit 300 with recesses therein and providing the second mechanically distinct unit as a flat plate, attaching mechanically distinct units 300 together by using fasteners other than bolts, or by permanent joining means such as welding, adhesives (e.g., epoxy or other glue) and the like. Exemplary variations of sensing device 400 include devices that sense color, pressure, temperature, speed of rotation and the like. Examples of the variations that could be implemented are illustrated in FIGS. 8 and 9.

FIG. 8 is a front elevation illustrating an alternative coupling member 600 that can couple a speedbag with a housing to measure athletic performance of a user of the speedbag.

Like coupling member 200 (FIG. 3), coupling member 600 couples speedbag 10 with housing 101 while also providing appropriate mechanical freedom for speedbag 10. Items that are numbered identically to coupling member 200 are identical; the only difference between coupling member 600 and coupling member 200, FIG. 3 is that bar 640 couples with axle 210 at one side only, leaving a gap 605 through which a strap of speedbag 10 may be passed in order to install and/or change out speedbag 10. Although gap 605 is shown as an open gap in FIG. 8, it is contemplated that other embodiments may include a catch or linking feature (e.g., similar to a carabiner) to mechanically close off gap 605 to keep speedbag 10 in place after it is installed.

Figure 9:
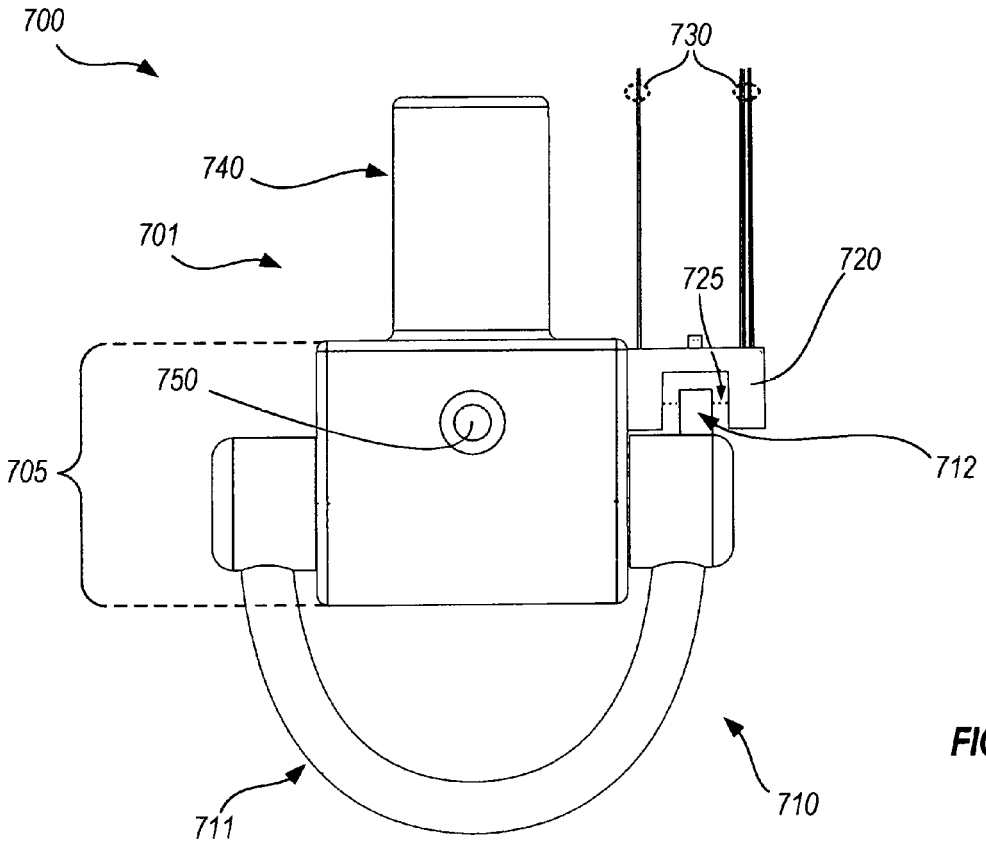
FIG. 9 is a front elevation of an embodiment of a performance monitor that includes a housing 701 that couples with a speedbag to measure athletic performance of a user of the speedbag, in accord with an embodiment.

FIG. 9 is a front elevation of an embodiment of a performance monitor 700 that includes a housing 701 that couples with a speedbag to measure athletic performance of a user of the speedbag. Performance monitor 700 includes a housing 701 having a swivel post 740 and a lower portion 705; a coupling member 710 couples speedbag 10 (not shown in FIG. 9) with housing 701 while also providing appropriate mechanical freedom for speedbag 10. Coupling member 710 rotates about an axle (like axle 210 of coupling member 200, but hidden in the view of FIG. 9) within an aperture of housing 701. Coupling member 710 includes a bar 711 to which a speedbag can couple, and a protrusion 712 that passes through a light beam 725 of a sensing device 720 as the speedbag moves coupling member 710. Thus, performance monitor 700 is similar to performance monitor 100 except that instead of arms of housing 101 surrounding a gap in which protrusion 112 moves so as to register motion of speedbag 10, housing 701 mounts sensing device 710 to the side. Materials and construction techniques of housing 701 are similar to those discussed above in connection with housing 101.

When speedbag 10 rotates protrusion 712 through a predefined rotational position, protrusion 712 will break light beam 725. In response to the interruption of beam 725, sensing device 400 generates an electrical signal within one of wires 730. A curvature or other dimension of bar 711 is sufficient for bar 711 to clear lower portion 705 as an axle of bar 711 rotates within an aperture of housing 101 (for example, similar to the apparatus shown in FIGS. 5 and 6). Wires 730 provide power, ground return and sensor-generated electrical connectivity for sensing device 720, and are examples of connections 50, FIG. 1. Housing 701 may be formed, for example, of mechanically distinct units that are assembled with an axle of coupling member 710 seated therebetween, and bolted together with a bolt 750. Although FIG. 9 shows sensing device 720 attached to an outside surface of housing 701, this is but one possible configuration, other embodiments of a housing like housing 701 can partially or completely encase sensing device 720 as suggested by partial assembly 102, FIG. 5. Similarly, other embodiments of a housing like housing 701 can form channels or recesses to protect wires 730, specifically such channels may route wires 730 up through swivel post 740 so that they can connect with a slip ring to avoid damaging wires 730 as housing 701 rotates relative to a platform in which it may be mounted.

It should thus be clear that a variety of manufacturing, assembly and operational strategies are contemplated as within the scope of the present application, up to and including an apparatus for measuring athletic performance that provides electrical signals from a coupling member to which a speedbag is mounted, apparatus for transmitting the electrical signals through wires or wirelessly, a processor that receives, interprets and displays a measure of athletic performance derived from the electrical signals, and further apparatus that stores the measure of athletic performance, generates statistics therefrom including associating the measure of athletic performance measured from time to time with given users of the speedbag, and the like.

Having described several embodiments, it will be recognized by those of skill in the art that various modifications, alternative constructions, and equivalents may be used without departing from the spirit of the invention. Additionally, a number of well-known processes and elements have not been described in order to avoid unnecessarily obscuring the present invention. Accordingly, the above description should not be taken as limiting the scope of the invention.

What is claimed is:

1. Apparatus for measuring athletic performance, comprising:

a swivel joint that includes:

a housing, comprising a swivel post coupled with first and second arms, each arm defining an aperture therethrough, the first and second arms defining a gap therebetween and oriented with the respective apertures aligned across the gap from one another;

a coupling member, comprising:

an axle that passes through the apertures and is rotatable with respect to the housing, the axle forming a protrusion that extends radially outward from the axle in a first radial direction, the protrusion being axially aligned with the gap; and a bar that couples with the axle, a dimension of the bar being sufficient for the bar to clear ends of the first and second arms as the axle rotates within the apertures, the bar extending radially in a second radial direction; and a sensing device that is mechanically coupled with the housing, and is responsive to produce an electrical signal representative of the athletic performance when rotation of the coupling member moves the protrusion through a predefined rotational position within the gap.

2. The apparatus of claim 1, wherein: the housing is formed of first and second mechanically distinct units; and at least portions of the first and second mechanically distinct units are joined by welding or gluing.

3. The apparatus of claim 1, wherein:

the housing is formed of first and second mechanically distinct units;

the first mechanically distinct unit includes first arm portions of each of the first and second arms, the second mechanically distinct unit includes second arm portions of each of the first and second arms, a first fastener couples one of the first arm portions of the first mechanically distinct unit with a corresponding one of the second arm portions of the second mechanically distinct unit, to form the first arm, and a second fastener couples another of the first arm portions of the first mechanically distinct unit with a corresponding one of the second arm portions of the second mechanically distinct unit, to form the second arm.

4. The apparatus of claim 3, wherein:

the first mechanically distinct unit defines a first recess that is orthogonal to the gap;

the second mechanically distinct unit defines a second recess that is orthogonal to the gap;

the first and second mechanically distinct units are disposed with the first and second recesses facing one another so as to form the apertures, and the axle is disposed within the apertures.

5. The apparatus of claim 3, wherein:

at least one of the first and second mechanically distinct units defines a third recess, and the sensing device is disposed at least partially within the third recess.

6. The apparatus of claim 5, wherein:

the at least one of the first and second mechanically distinct units defines a first portion of the third recess within the first arm, a light source of the sensing device being disposed at least partially within the first portion of the third recess; and the at least one of the first and second mechanically distinct units defines a second portion of the third recess within the second arm, a photosensor of the sensing device being disposed at least partially within the second portion of the third recess.

7. The apparatus of claim 3, wherein:

the first arm portions of the first mechanically distinct unit separate at a proximal end of the gap, and couple at a distal end of the gap.

8. The apparatus of claim 1, wherein:

the sensing device is a photointerruptor comprising:

a light source that projects a light beam across the gap; and a photosensor that develops the electrical signal when the light beam is interrupted by the protrusion passing through the gap.

9. The apparatus of claim 1, further comprising means for transmitting the electrical signal to a processor remote from the swivel joint, wherein the processor processes the electrical signal to determine a measure of the athletic performance.

10. The apparatus of claim 9, wherein the means for transmitting the electrical signal to the processor remote from the swivel joint comprises a slip ring operable to connect the electrical signal to wiring while the swivel joint rotates.

11. The apparatus of claim 9, wherein the means for transmitting the electrical signal to the processor remote from the swivel joint comprises a wireless connection.

12. The apparatus of claim 9, wherein the processor processes the electrical signal by counting signal portions that represent motion of the protrusion through the predefined rotational position, and the measure of the athletic performance is a rate of the signal portions per unit time.

13. The apparatus of claim 1, further comprising a speedbag coupled with the bar, wherein:

when the speedbag is punched by a user, the bar rotates the axle such that the protrusion moves through the predefined rotational position and is sensed by the sensing device; and the athletic performance measured is a frequency with which the protrusion moves through the gap.

14. The apparatus of claim 13, further comprising a platform with which the swivel joint is coupled.

15. The apparatus of claim 14, the speedbag couples with the platform through a slip ring that allows the swivel post to rotate.

16. The apparatus of claim 14, further comprising a processor that processes the electrical signal to determine a speed with which the user punches the speedbag, and a display coupled with the platform, the display being operatively coupled with the processor to display the speed with which the user punches the speedbag.

17. The apparatus of claim 13, further comprising a processor that processes the electrical signal to determine performance information related to a speed with which the user punches the speedbag, and transmits the performance information to a computer system that is remotely located.

18. Apparatus for measuring athletic performance, comprising:

a swivel joint that includes:

a housing, comprising a swivel post coupled with a lower portion, the lower portion defining at least one aperture therethrough, a coupling member, comprising:

an axle that passes through the at least one aperture and is rotatable with respect to the housing, the axle forming a protrusion that extends radially outward from the axle in a first radial direction, and a bar that couples with the axle, a dimension of the bar being sufficient for the bar to clear the lower portion of the housing as the axle rotates within the at least one aperture, the bar extending radially in a second radial direction sensing device that is mechanically coupled with the housing, and is responsive to produce an electrical signal representative of the athletic performance when rotation of the coupling member moves the protrusion through a predefined rotational position adjacent to the sensing device.

19. The apparatus of claim 18, wherein:

the housing is formed of first and second mechanically distinct units;

the first mechanically distinct unit defines a first recess;

the second mechanically distinct unit defines a second recess;

the first and second mechanically distinct units are disposed with the first and second recesses facing one another so as to form the aperture, the axle is disposed within the aperture, and at least one fastener couples the first mechanically distinct unit with second mechanically distinct unit.

20. The apparatus of claim 19, wherein:

the sensing device is a photointerruptor comprising: a light source that projects a light beam; and a photosensor that develops the electrical signal when the light beam is interrupted by the protrusion.

* * * * *